US006589079B2

(12) United States Patent
Kashiyama et al.

(10) Patent No.: US 6,589,079 B2
(45) Date of Patent: Jul. 8, 2003

(54) CONNECTOR HAVING AT LEAST ONE CONTACT-PIN INSERTING PORT FOR A CONDUCTION-TEST TOOL

(75) Inventors: Motohisa Kashiyama, Shizuoka (JP); Haruki Yoshida, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/804,247

(22) Filed: Mar. 13, 2001

(65) Prior Publication Data

US 2001/0023147 A1 Sep. 20, 2001

(30) Foreign Application Priority Data

Mar. 14, 2000 (JP) ..... P. 2000-071251

(51) Int. Cl.[7] ..... H01R 13/40
(52) U.S. Cl. ..... 439/595; 439/912
(58) Field of Search ..... 439/595, 488, 439/912

(56) References Cited

U.S. PATENT DOCUMENTS 5,614,820 A 3/1997 Aoyama et al. ..... 324/158
5,694,043 A 12/1997 Kodama
5,703,279 A 12/1997 Igura et al.
5,718,603 A 2/1998 Watanabe et al.
6,129,596 A * 10/2000 Yamatani ..... 439/752

FOREIGN PATENT DOCUMENTS

JP 7-254449 10/1995

* cited by examiner

*Primary Examiner*—Renee Luebke
*Assistant Examiner*—Ann McCamey
(74) *Attorney, Agent, or Firm*—Sughrue Mion, PLLC

(57) ABSTRACT

A connector (21) includes at least one terminal (23) and a connector housing (22) having a terminal receiving chamber into which the at least one terminal (23) is insertable. The connector housing (22) has at least one connection port (33) through which a mating terminal is insertable, a detection-pin inserting port (34) through which a lance-displacement detecting pin of a connector conduction-test tool is insertable, and a contact-pin inserting port (35) through which a conduction contact pin (24) of the connector conduction-test tool is insertable. The contact-pin inserting port 35 is formed in such a manner as to cut away an edge portion of the connection port (33).

8 Claims, 5 Drawing Sheets

CONNECTOR HAVING AT LEAST ONE CONTACT-PIN INSERTING PORT FOR A CONDUCTION-TEST TOOL

BACKGROUND OF THE INVENTION

1. Field of the Invention

The present invention relates to a connector having at least one contact-pin inserting port for a conduction contact pin of a connector conduction-test tool.

The present application is based on Japanese Patent Application No. 2000-071251, which is incorporated herein by reference.

2. Description of the Related Art

In FIG. 6, a connector 1 includes a plurality of (only one is shown, hereinafter the same) terminals 2 formed of an electrically conductive metal plate and a connector housing 3 formed of a synthetic resin. The terminal 2 in FIG. 6 is a female terminal and is provided with a box-shaped electrical contact portion 5 having a resilient contact 4 and a wire connecting portion 6 continuing to the electrical contact portion 5. An engaging hole 7 for retaining a terminal is formed in the electrical contact portion 5.

A plurality of terminal receiving chambers 8 for accommodating the terminals 2 are formed in the connector housing 3. In addition, connection ports 9 communicating with the respective terminal receiving chambers 8 and detection-pin inserting ports 10 are formed in the connector housing 3.

A lance 11 for retaining the accommodated terminal 2 is formed in the terminal receiving chamber 8. Further, a deflection space 12 for the lance 11 is also formed therein. The lance 11 is formed in such a manner as to be deflectable in the deflection space 12. A pawl-like retaining portion 13 is formed on the distal end side of the lance 11. The retaining portion 13 is adapted to be engaged with the engaging hole 7 for the terminal 2.

A male terminal (not shown), which is a mating member to be connected, is adapted to be inserted in the connection port 9. Further, a lance-displacement detecting pin 15 of a connector conduction-test tool 14 of a known construction is adapted to be inserted in the detection-pin inserting port 10.

When the connector 1 is assembled with the plurality of terminals 2 accommodated in the connector housing 3, the connector 1 is set in the connector conduction-test tool 14, a conductivity test with respect to the terminals 2 in the connector 1 and the detection of incomplete insertion are performed simultaneously.

If the terminals 2 are accommodated positively, the lance-displacement detecting pin 15 is inserted up to the innermost portion of the deflection space 12. At this time, conduction contact pins 16 of the connector conduction-test tool 14 are inserted through the connection ports 9, and are brought into contact with the resilient contacts 4 of the terminals 2. When the conduction contact pins 16 are brought into contact with the resilient contacts 4, the presence or absence of conductivity can be confirmed.

At the time of the above-described conductivity test, since the conduction contact pins 16 of the connector conduction-test tool 14 are inserted through the connection ports 9 and are brought into contact with the resilient contacts 4 of the terminals 2, there is a possibility of the resilient contacts 4 of the terminals 2 becoming deformed and damaged due to the action involved in their contact.

Since the deformation and damage of the resilient contacts 4 affect the connection with the mating male terminals (not shown), there has been a need for improvement. Further, improvement has been required for performing the conductivity test reliably.

SUMMARY OF THE INVENTION

The present invention has been devised in view of the above-described circumstances, and an object of the present invention is to provide a connector which makes it possible to prevent the deformation of and damage to the resilient contacts of the terminals and perform the conductivity test reliably.

To achieve the above object, according to a first aspect of the present invention, there is provided a connector which comprises a connector housing including at least one terminal receiving chamber into which a terminal is insertable, at least one connection port, which communicates with the at least one terminal receiving chamber, and through which a mating terminal is insertable, and at least one detection-pin inserting port, which communicates with the at least one terminal receiving chamber, and through which a lance-displacement detecting pin of a connector conduction-test tool is insertable, wherein the at least one detection-pin inserting port is formed to continue from an edge portion of the at least one connection port; and at least one contact-pin inserting port, through which a conduction contact pin of the connector conduction-test tool is insertable, formed in such a manner as to cut out an opposing edge portion of the at least one connection port which is opposed to the edge portion of the at least one connection port.

In accordance with the first aspect of the present invention, at the time of a conductivity test using a connector conduction-test tool, the conduction contact pin is inserted through not a connection port of the connector but the contact-pin inserting port. Therefore, the position of contact of the conduction contact pin with the terminal is offset from a portion involved in the contact with a mating terminal.

According to a second aspect of the present invention, it is preferable that the connector further comprises a tapering surface, for guiding the conduction contact pin into the terminal receiving chamber, formed on the at least one contact-pin inserting port.

In accordance with the second aspect of the present invention, since the tapering surface is formed on the contact-pin inserting port, the conduction contact pin is smoothly guided into the terminal receiving chamber at the time of the conductivity test using the connector conduction-test tool.

According to a third aspect of the present invention, it is preferable that the connector further comprises an inclined surface, for guiding the mating terminal into the terminal receiving chamber, formed at least on the opposing edge portion.

In accordance with the third aspect of the present invention, since the inclined surface is formed at least on an edge portion of the connection port on the side where the contact-pin inserting port is disposed, the mating terminal is smoothly guided into the terminal receiving chamber even if the contact-pin inserting port is provided.

According to a fourth aspect of the present invention, it is preferable that depth of the at least one contact-pin inserting port with respect to the opposing edge portion of the at least one connection port is formed to be deeper than a thickness of the conduction contact pin.

In accordance with the fourth aspect of the present invention, since the depth of the contact-pin inserting port is formed to be deeper than the thickness of the conduction contact pin, the position of contact of the conduction contact pin with the terminal is further offset from the portion involved in the contact with the mating terminal.

DETAILED DESCRIPTION OF THE PREFERRED EMBODIMENT

A preferred embodiment of the present invention now will be described with reference to FIGS. 1 to 5.

Figure 1:
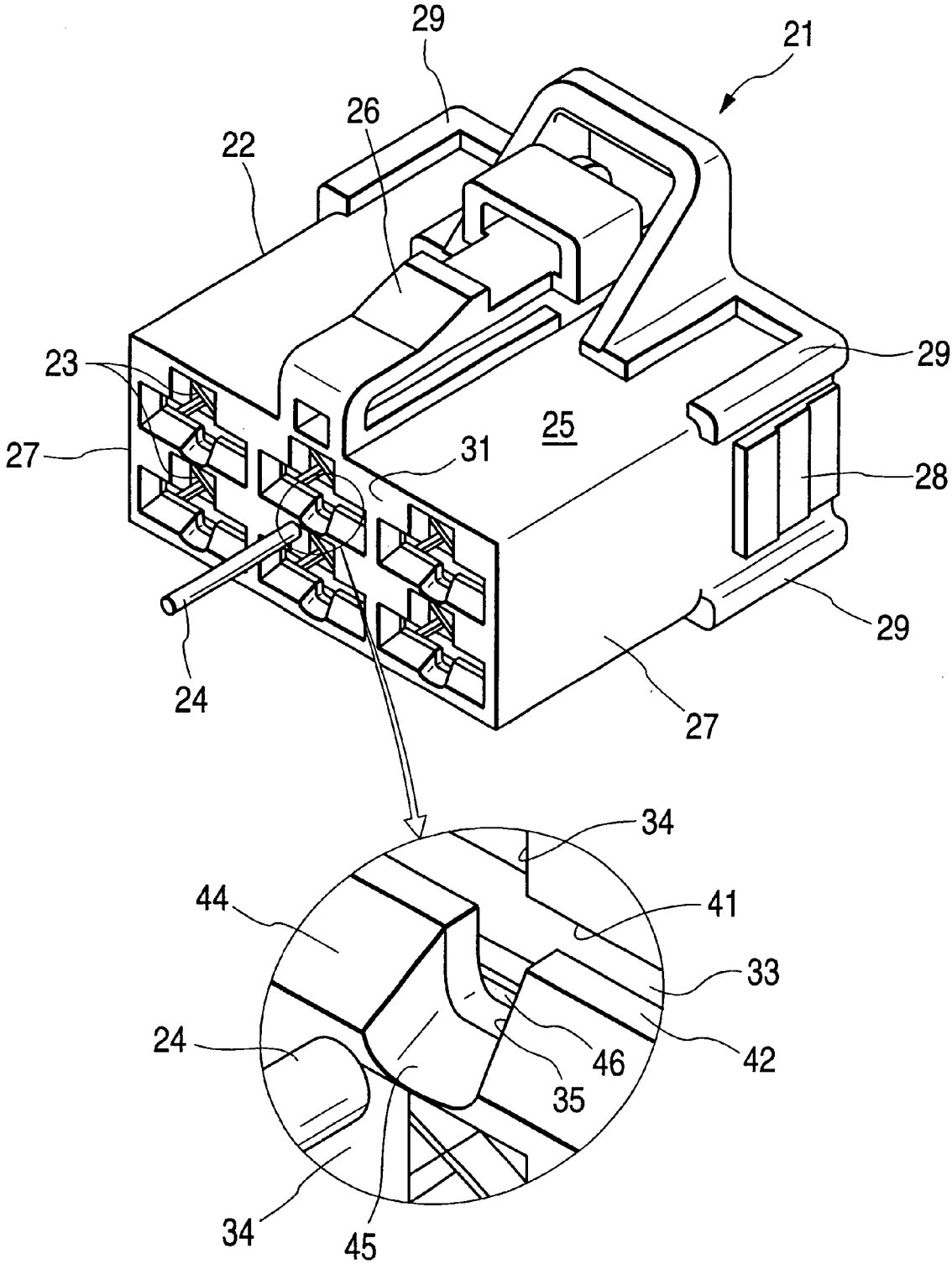
FIG. 1 is a perspective view of an external appearance (the portion in the circle is an enlarged view of an essential portion) illustrating an embodiment of a connector in accordance with the present invention.
Figure 2:
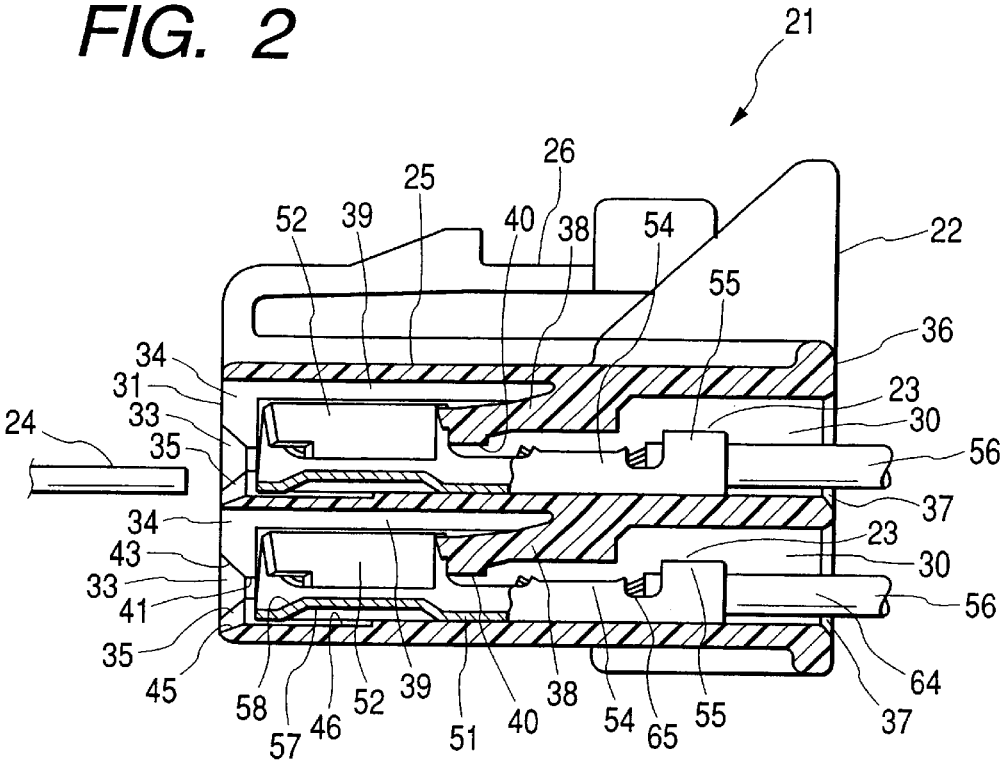
FIG. 2 is a vertical cross-sectional view of the connector shown in FIG. 1.

In FIGS. 1 and 2, a connector 21 which is used for connecting a wire harness or the like for automobile use, for example, comprises a connector housing 22 formed of a synthetic resin and a plurality of (six in this embodiment, the number being not limited to it) terminals 23 formed of an electrically conductive metal plate. As will be described later in detail, in the connector 21 according to the embodiment an improvement has been made for conduction contact pins 24 of a connector conduction-test tool (not shown).

First, a description will be given of the above-described construction, and then a description will be given of the operation at the time of a conductivity test using the aforementioned connector conduction-test tool (not shown).

The connector housing 22 is formed in a box shape, and a known retaining means 26 (e.g., a locking arm) is formed integrally on its upper wall 25. Further, a pair of stepped pinching potions 28 (only one is shown) are projectingly formed on rear portions of both side walls 27 of the connector housing 22. Reference numeral 29 denotes a rib for setting with respect to the connector conduction-test tool (not shown).

Figure 6:
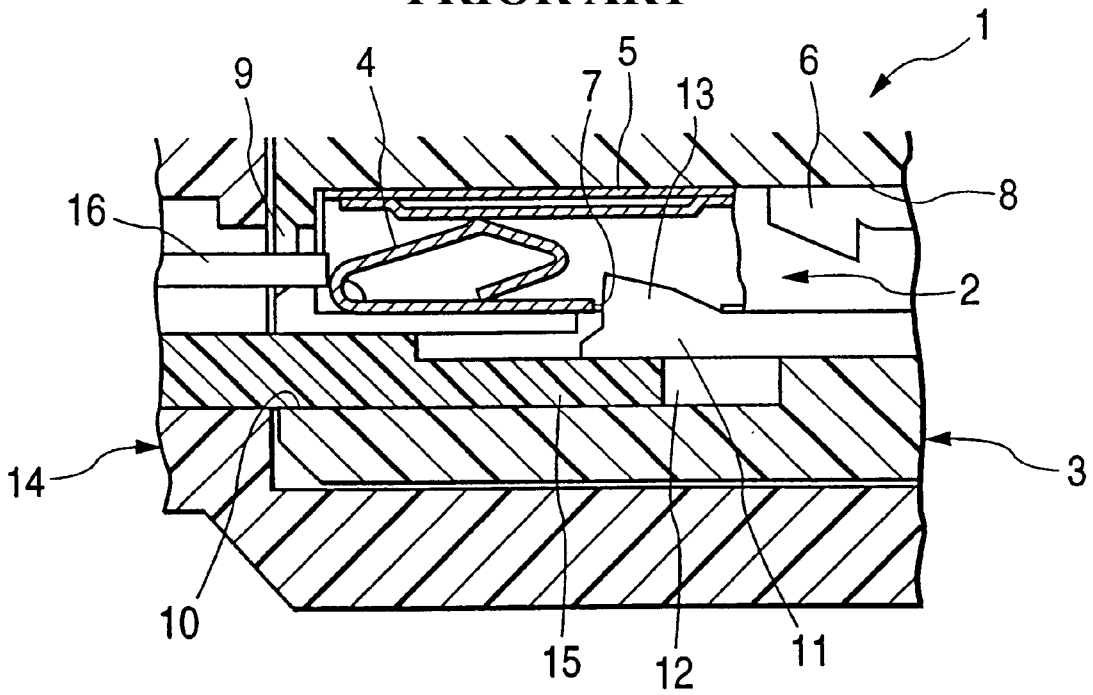
FIG. 6 PRIOR ART
FIG. 6 is a vertical cross-sectional view illustrating a state in which a conductivity test is being performed by setting a connector of a related example in a connector conduction-test tool.

A plurality of (six in this embodiment, the number being not limited to it) terminal receiving chambers 30 are formed inside the connector housing 22. Further, formed in a front wall 31 of the connector housing 22 are connection ports 33 for male terminals 32 (see FIG. 3), which are mating members to be connected, detection-pin inserting ports 34 for lance-displacement detecting pins (not shown, see FIG. 6) of the connector conduction-test tool (not shown), and contact-pin inserting ports 35 for the conduction contact pins 24. The front wall 31 also serves as a stopper for the terminals 23 which are accommodated. Terminal inserting ports 37 communicating with the respective terminal receiving chambers 30 are formed in a rear wall 36 of the connector housing 22.

The terminal receiving chambers 30 are formed in such a manner as to be arranged in threes in two, i.e., upper and lower, stages. In addition, each terminal receiving chamber 30 is formed by being defined by four surfaces including those of partition walls so as to have a rectangular parallelopiped-shaped space. A flexible lance 38 for retaining the terminal and a deflection space 39 for the lance 38 are formed in each terminal receiving chamber 30.

The lance 38 is formed midway on an upper surface defining the terminal receiving chamber 30 in such a manner as to project substantially in the form of an arm. Further, before the terminal 23 is accommodated, a tip of the lance 38 is formed in such a manner as to be oriented diagonally downward. The tip of the lance 38 is directed toward the front wall 31 side, and a projecting retaining portion 40 is formed at the tip. The retaining portion 40 is formed on the side of a lower surface defining the terminal receiving chamber 30. When the terminal 23 is accommodated in the terminal receiving chamber 30, the movement of the terminal 23 in its inserting and withdrawing directions is restricted by the lance 38 and the front wall 31.

The deflection space 39 is formed between a proximal end portion of the lance 38 and the detection-pin inserting port 34. Since the deflection space 39 is formed, the lance 38 can be deflected by the terminal 23.

Figure 3:
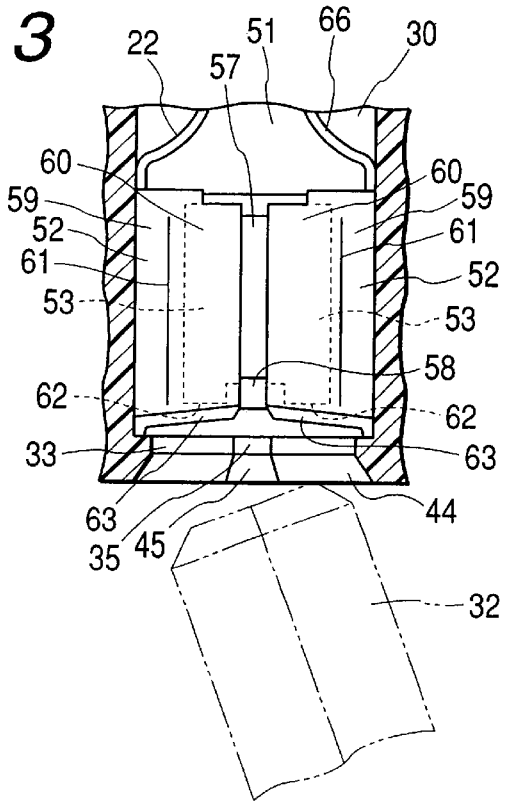
FIG. 3 is a horizontal cross-sectional view of the connector illustrating only a contact-pin inserting port and its vicinity.

The connection ports 33 are formed in the shape of horizontally elongated holes in conformity with the shape of the male terminals 32 (see FIG. 3). Further, each connection port 33 has an inclined surface 43 and an inclined surface 44 for the male terminal 32 (see FIG. 3), which are respectively provided on outer sides of its edge portion 41 and an opposing edge portion 42 opposing the edge portion 41. Since the inclined surfaces 43 and 44 are formed, the male terminals 32 (see FIG. 3) can be guided smoothly into the terminal receiving chambers 30.

Each detection-pin inserting port 34 is formed by being arranged on an upper surface side of the terminal receiving chamber 30 relative to the connection port 33. Further, the detection-pin inserting port 34 has a narrower width than the connection port 33, and is formed in such a manner as to continue to the edge portion 41 of the connection port 33. The detection-pin inserting port 34 is essentially formed so as to form the lance 38.

Each contact-pin inserting port 35 is formed by being arranged on a lower surface side of the terminal receiving chamber 30 relative to the connection port 33. Further, the contact-pin inserting port 35 is formed on a side located away from the detection-pin inserting port 34 with the connection port 33 located therebetween. Namely, the contact-pin inserting port 35 is formed in such a manner as to continue to the opposing edge portion 42 of the connection port 33. The contact-pin inserting port 35 is formed by being cut out substantially in a U-shape at a center of the opposing edge portion 42. Its depth (depth from the opposing edge portion 42) is formed to be deeper than the diameter (or thickness) of the conduction contact pin 24, and a tapering surface 45 is formed integrally thereon. The tapering surface 45 is formed to guide the conduction contact pin 24 smoothly into the terminal receiving chamber 30. The contact-pin inserting port 35 is formed in such a manner as to continue to a shallow groove 46 formed in the aforementioned lower surface of the terminal receiving chamber 30.

It should be noted that, as for the aperture (width) of the contact-pin inserting port 35 on its outer side and the aperture (width) thereof on its inner side, the aperture (width) on the outer side is formed to be wider (to allow the conduction contact pin 24 to be received more easily). The arrangement provided is such that the width and the like of the contact-pin inserting port 35 are set appropriately so as not to be caught by the male terminal 32 (see FIG. 3). Namely, it is preferred that even if the contact-pin inserting port 35 is located on the inclined surface 44 (see FIG. 3), the male terminal 32 (see FIG. 3) should be guided smoothly into the terminal receiving chamber 30.

As shown in FIGS. 2 and 3, the terminal 23 is of a female type, and is fabricated by pressing an electrically conductive thin metal plate a number of times. The terminal 23 includes a substantially spatula-shaped base plate portion 51; a pair of resilient curl portions 52 and a pair of electrical contacts 53 which are formed on the front side of the base plate portion 51; and a pair of conductor crimping portions 54 (only one is shown, hereinafter the same) and a pair of covering crimping portions 55 (only one is shown, hereinafter the same) which are formed on the rear side of the base plate portion 51. Reference numeral 56 denotes an electric wire which is crimped and connected.

An electrical contact protrusion 57 which bulges toward the resilient curl portions 52 is formed on the front side of the base plate portion 51 by striking out. The electrical contact protrusion 57 is adapted to nip the male terminal 32 in cooperation with the electrical contacts 53. A tapering surface 58 is formed around the entire periphery of the electrical contact protrusion 57.

The pair of resilient curl portions 52 are respectively formed in such a manner as to continue from both sides of the front side of the base plate portion 51, and are formed in the shape of strips whose widths along the extending direction of the base plate portion 51 are wide (i.e., they are resilient contacts). Further, the resilient curl portions 52 are formed by being bent inwardly so as to be substantially chevron-shaped in a cross-sectional view. Outer slanting surfaces (because the resilient curl portions 52 are substantially chevron-shaped) 59 of the pair of resilient curl portions 52 are formed as sharply slanting surfaces close to a perpendicular direction with respect to the base plate portion 51. In contrast, inner slanting surfaces 60 are formed as sufficiently gentler slanting surfaces than the outer slanting surfaces 59. Reference numeral 61 denotes a ridge portion of the resilient curl portion 52.

The pair of electrical contacts 53 are belt-shaped pieces extending along the extending direction of the base plate portion 51, and are formed by bending tips of the resilient curl portions 52 slightly upward at a slight angle. Front ends 62 of the electrical contacts 53 are formed in such a manner as to be curved upward so as to guide the unillustrated mating male terminal to a predetermined position. Further, the front ends 62 of the electrical contacts 53 are formed in such a manner as to be located inwardly of front ends 63 of the resilient curl portions 52.

The pair of conductor crimping portions 54 are rectangular strip-shaped portions for crimping a core portion 65 exposed by stripping off a covering 64 at a terminal portion of the wire 56, and are respectively formed in such a manner as to continue from both sides at a slightly forward position of the rear side of the base plate portion 51. When the conductor crimping portions 54 are caulked, the core portion 65 is crimped. It should be noted that reference numeral 66 denotes a frame portion.

The pair of covering crimping portions 55 are portions for crimping the covering 64 of the wire 56, are formed in the shape of rectangular strips longer than the pair of conductor crimping portions 54, and are respectively formed in such a manner as to continue from both sides at a slightly rearward position of the rear side of the base plate portion 51. When the covering crimping portions 55 are caulked, the core portion 65 on the inner side of the covering 64 is compressed by means of the covering 64.

Meanwhile, the connector conduction-test tool (not shown) is arranged such that the aforementioned conduction contact pin 24 and the lance-displacement detecting pin (not shown) are set as one set so as to be able to perform a conductivity test and the detection of incomplete insertion for each terminal 23 (since the arrangement is known, a description thereof will be omitted; Unexamined Japanese Patent Publication No. Hei. 7-254449 and the like serve as references).

In the above-described arrangement, as the corresponding terminals 23 are inserted in the respective terminal receiving chambers 30, the connector 21 is assembled. Namely, in FIG. 2, if the terminal 23 is inserted into each terminal receiving chamber 30 through the terminal inserting port 37, the lance 38 in the terminal receiving chamber 30 undergoes resilient deformation due to the action by the terminal 23. In this state, if the terminal 23 is further pressed and is accommodated until the terminal 23 abuts against the front wall 31, the action from the terminal 23 is canceled, and the lance 38 returns to its original position owing to its restoring force. As the lance 38 is engaged with the terminal 23, the terminal 23 is prevented from coming off the terminal receiving chamber 30.

Figure 4:
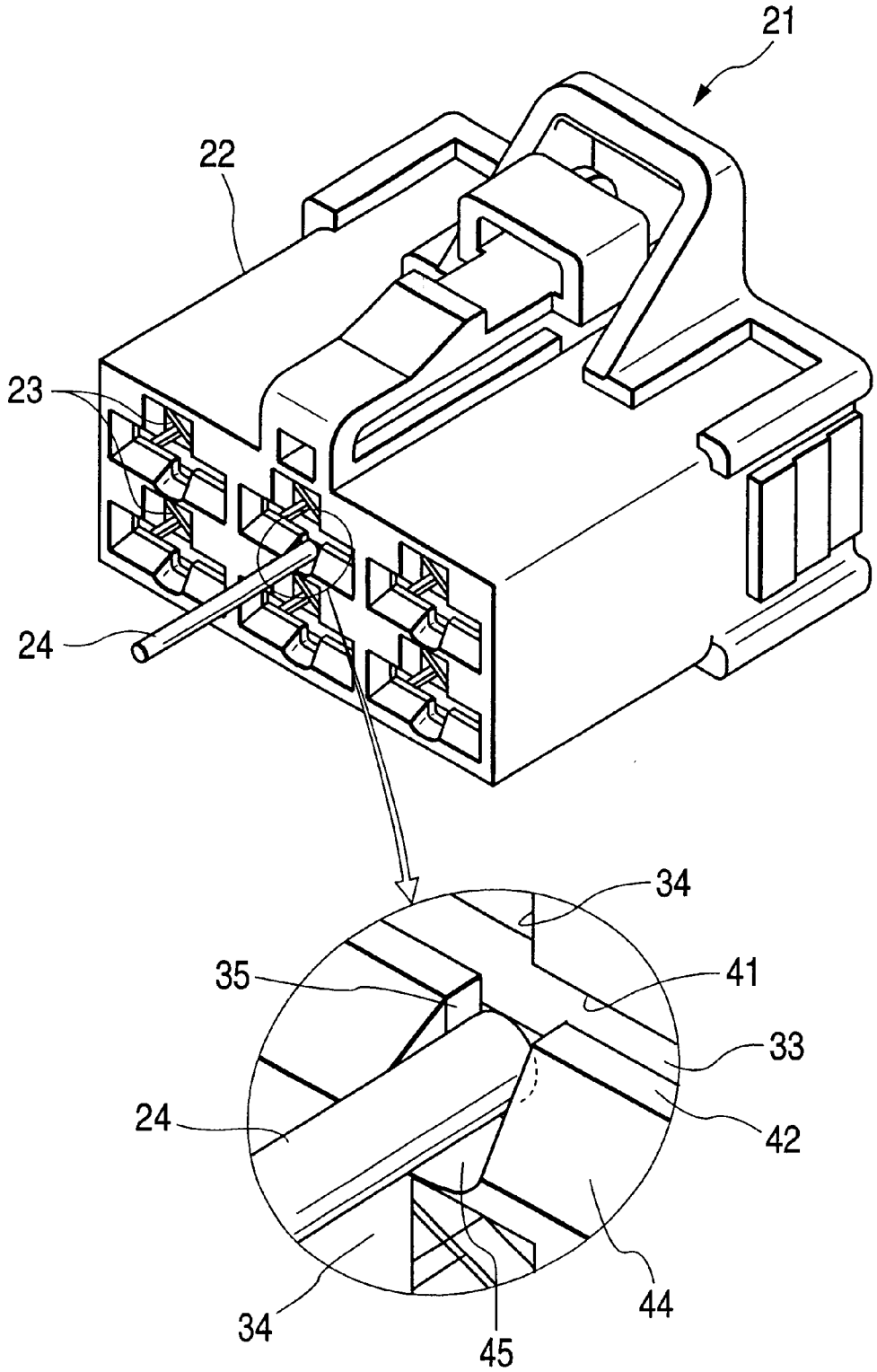
FIG. 4 is a perspective view of the external appearance (the portion in the circle is an enlarged view of the essential portion) illustrating a state in which a conduction contact pin is inserted.
Figure 5:
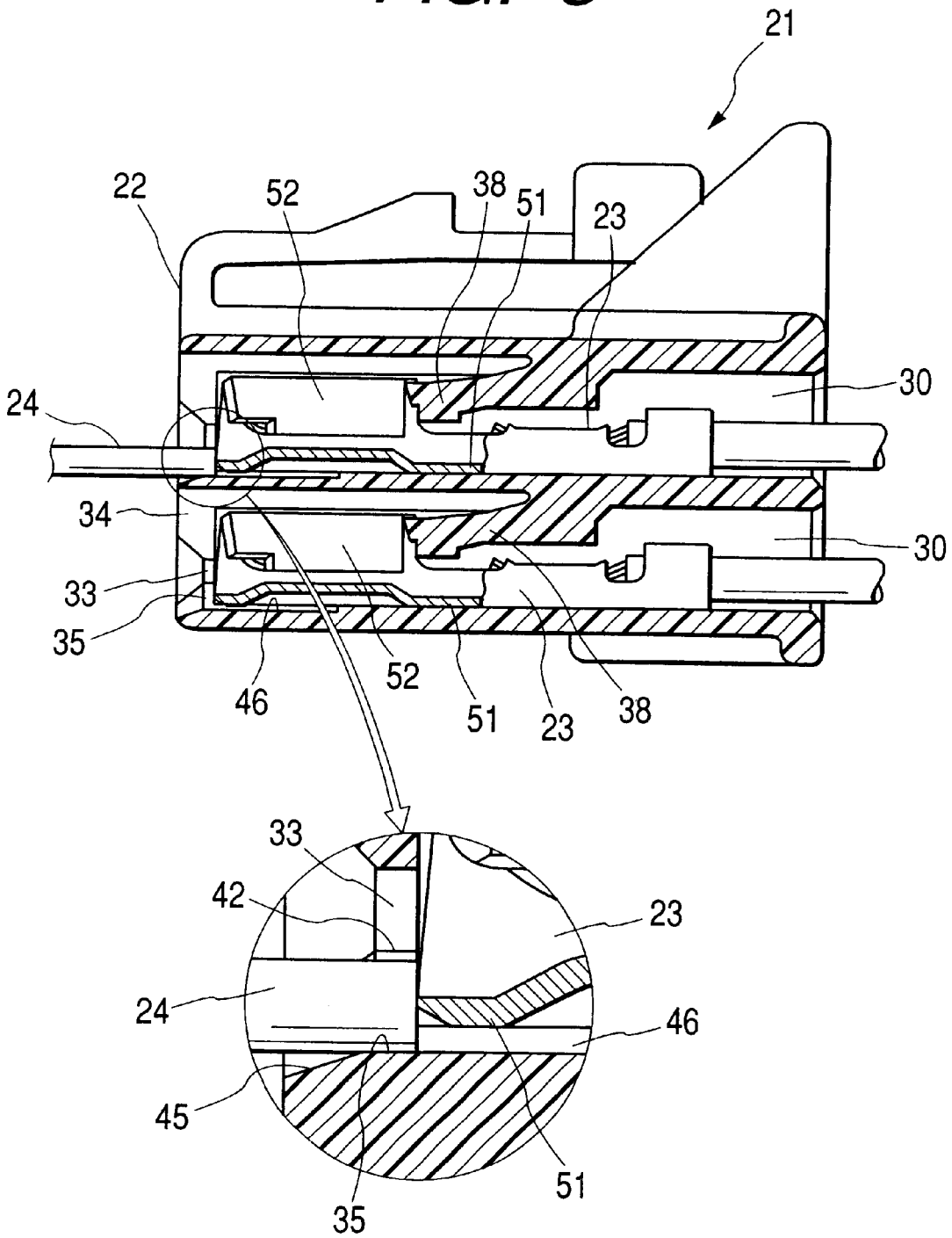
FIG. 5 is a vertical cross-sectional view (the portion in the circle is an enlarged view of the essential portion) of the connector shown in FIG. 4.

When all the terminals 23 are accommodated in the corresponding terminal receiving chambers 30, the assembly of the connector 21 is completed. With respect to the completed connector 21, the presence or absence of a midway-inserted state and the presence or absence of conductivity of the terminals 23 are inspected by the connector conduction-test tool (not shown). In FIG. 4 or 5, the conduction contact pins 24 are inserted into the respective contact-pin inserting ports 35. Each conduction contact pin 24 is guided by the tapering surface 45 and is inserted smoothly into the terminal receiving chamber 30.

Since the conduction contact pin 24 is inserted at the lower surface side relative to the opposing edge portion 42 of the connection port 33, the conduction contact pin 24 is conductingly connected to a front end of the base plate portion 51 of the terminal 23. Since the shallow groove 46 is formed on the lower surface of the terminal receiving chamber 30, the center of the conduction contact pin 24 is conductingly connected to a front end of the base plate portion 51. The base plate portion 51 is not deformed or damaged by the contact with the conduction contact pin 24. In addition, since the conduction contact pin 24 is not brought into contact with the resilient curl portions 52 (only one is shown), the conduction contact pin 24 does not affect the contact with the male terminal 32 (see FIG. 3).

Incidentally, it suffices if the contact-pin inserting ports 35 are formed such that the conduction contact pin 24 is able to come into contact with a portion which is difficult to be displaced or damaged, such as the front end of the base plate portion 51.

In addition, it goes without saying that various modifications of the present invention are possible without departing from the gist of the present invention.

As described above, in accordance with the first aspect of the present invention, since the contact-pin inserting port for inserting the conduction contact pin of the connector conduction-test tool therethrough is formed in such a manner as to cut out the connection port, the conduction contact pin can be inserted through a portion other than the insertion port at the time of a conductivity test using the connector conduction-test tool. In other words, the conduction contact pin can be made not to come into contact with a portion of the accommodated terminal involved in connection with the mating terminal, i.e., the resilient contact. As a result, it is possible to prevent the deformation of and damage to the resilient contacts of the terminals. In addition, the conductivity test can be performed reliably.

In accordance with the second aspect of the present invention, since the tapering surface is formed on the contact-pin inserting port, the conduction contact pin can be smoothly guided into the terminal receiving chamber at the time of the conductivity test using the connector conduction-test tool.

In accordance with the third aspect of the present invention, since the inclined surface is formed at least on an edge portion of the connection port on the side where the contact-pin inserting port is disposed, even if the contact-pin inserting port is provided, the mating terminal can be smoothly guided into the terminal receiving chamber.

In accordance with the fourth aspect of the present invention, since the depth of the contact-pin inserting port is formed to be deeper than the thickness of the conduction contact pin, the position of contact of the conduction contact pin with the terminal can be further offset from the portion involved in the contact with the mating terminal.

What is claimed is:

1. A connector system, comprising:

a terminal including a resilient portion and a base plate;

a connector conduction-test tool including a lance-displacement detecting pin and a conduction contact pin; and a connector housing including:

at least one terminal receiving chamber into which the terminal is inserted, at least one connection port, which communicates with the at least one terminal receiving chamber, and through which a mating terminal is insertable, and at least one detection-pin inserting port, which communicates with the at least one terminal receiving chamber, and through which the lance-displacement detecting pin of the connector conduction-test tool is insertable, wherein the at least one detection-pin inserting port is formed to continue from an edge portion of the at least one connection port; and at least one contact-pin inserting port, through which the conduction contact pin of the connector conduction-test tool is insertable to contact the terminal, formed in such a manner as to cut out an opposing edge portion of the at least one connection port which is opposed to the edge portion of the at least one connection port;

wherein the conduction contact pin contacts the base plate when the conduction contact pin is inserted into the contact-pin inserting port.

2. The connector system of claim 1, wherein the contact-pin inserting port is substantially aligned with the base plate.

3. The connector system of claim 1, wherein the width of the at least one contact-pin inserting port with respect to the opposing edge portion of the at least one connection port is formed to be wider than a thickness of the conduction contact pin.

4. The connector system of claim 2, wherein the width of the at least one contact-pin inserting port with respect to the opposing edge portion of the at least one connection port is formed to be wider than a thickness of the conduction contact pin.

5. A connector system, comprising:

a terminal including a resilient portion and a base plate;

a connector conduction-test tool including a conduction contact pin; and a connector housing including:

at least one terminal receiving chamber into which the terminal is inserted, at least one connection port, which communicates with the at least one terminal receiving chamber, and through which a mating terminal is insertable, and at least one contact-pin inserting port, through which the conduction contact pin of the connector conduction-test tool is insertable to contact the terminal, wherein the conduction contact pin contacts the base plate when the conduction contact pin is inserted into the contact-pin inserting port.

6. The connector system of claim 5, wherein the contact-pin inserting port is substantially aligned with the base plate.

7. The connector system of claim 6, wherein the width of the at least one contact-pin inserting port with respect to the opposing edge portion of the at least one connection port is formed to be wider than a thickness of the conduction contact pin.

8. The connector system of claim 7, wherein the width of the at least one contact-pin inserting port with respect to the opposing edge portion of the at least one connection port is formed to be wider than a thickness of the conduction contact pin.

* * * * *